US006516921B1

(12) United States Patent
Wang

(10) Patent No.: US 6,516,921 B1
(45) Date of Patent: Feb. 11, 2003

(54) PROTECTIVE MEANS AGAINST INERTIAL SLIP OF ELEVATOR CAB DURING BRAKE RELEASE IN AN EMERGENCY

(76) Inventor: Jiun Jyh Wang, No. 50, Alley 97, Lane 354, San Her Rd., Feng Yuan, Taichung Hsien (TW)

( * ) Notice: Subject to any disclaimer, the term of this patent is extended or adjusted under 35 U.S.C. 154(b) by 10 days.

(21) Appl. No.: 09/908,068

(22) Filed: Jul. 17, 2001

(51) Int. Cl.[7] ..... B66B 11/08
(52) U.S. Cl. ..... 187/263; 187/306; 187/377
(58) Field of Search ..... 187/254, 263, 187/266, 290, 291, 298, 306, 314, 350, 377

(56) References Cited

U.S. PATENT DOCUMENTS 2,265,891 A * 12/1941 Bertelsen ..... 187/263
4,592,450 A * 6/1986 Schaffer ..... 187/263
5,680,911 A * 10/1997 Wang ..... 187/263
5,713,433 A * 2/1998 Wang ..... 187/263
5,890,565 A * 4/1999 Wang ..... 187/263
5,906,252 A * 5/1999 Wang ..... 187/263
5,971,109 A * 10/1999 Aulanko et al. ..... 187/263
6,116,380 A * 9/2000 Wang ..... 187/263
6,273,216 B1 * 8/2001 Kocher et al. ..... 187/377

* cited by examiner

*Primary Examiner*—Christopher P. Ellis
*Assistant Examiner*—Paul T. Chin
(74) *Attorney, Agent, or Firm*—Pro-Techtor International Services

(57) ABSTRACT

A manual brake release control structure having a linking member cooperates with an escape and protection mechanism for an elevator to protect an emergently braked elevator cab against inertial slip during brake release. By pulling an escape pulling cable outside the cab with a normal force, the braked cab is released to move and rotate a rotary shaft of a driving motor of the elevator. The rotary shaft in rotating causes a cam connected thereto to rotate and thereby reciprocates the linking member up and down that in turn causes an actuating arm and a flexible long member to repeatedly release and depress a braking device of the elevator, so that the cab is intermittently braked and released to move upward or downward at a reduced safety speed.

3 Claims, 5 Drawing Sheets

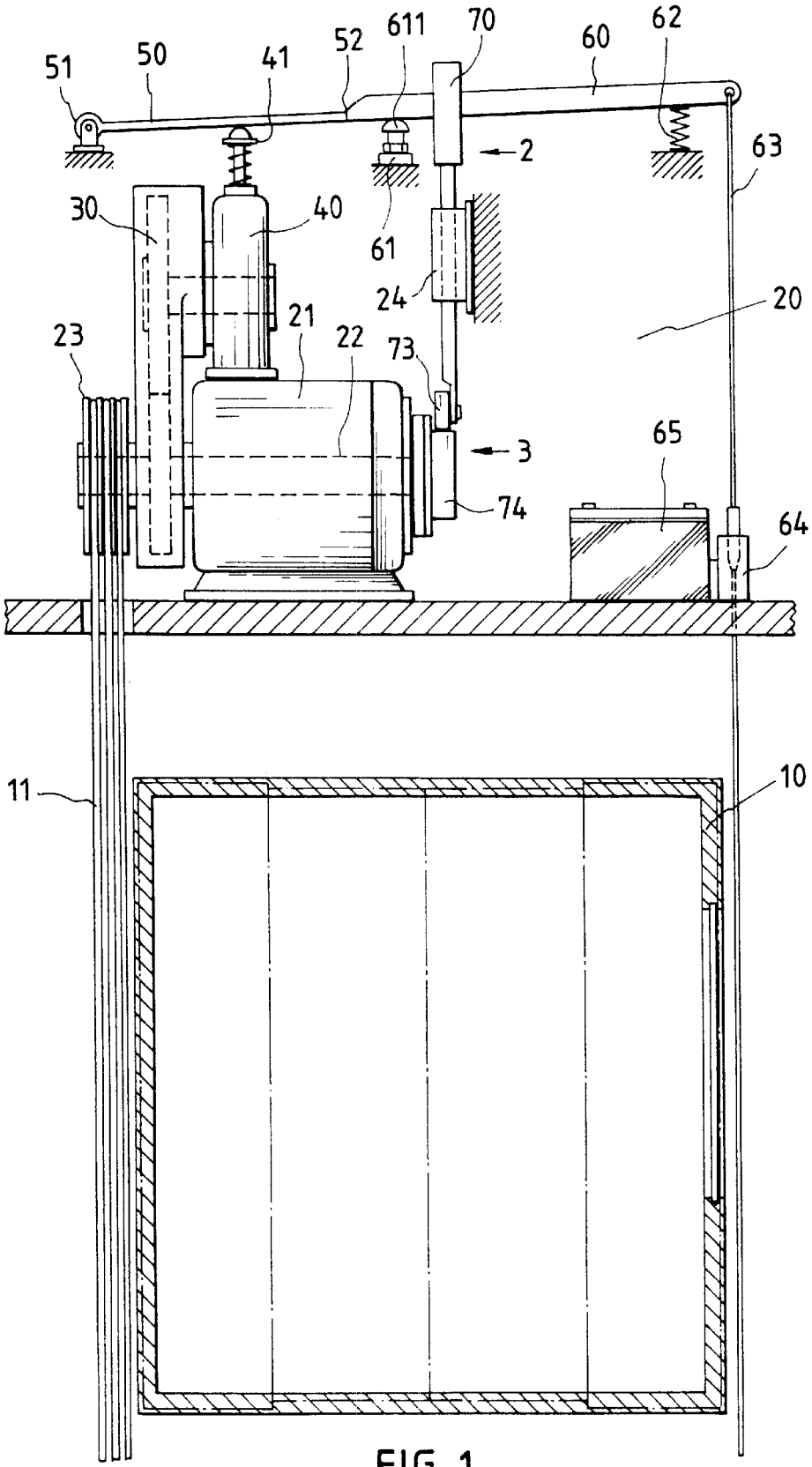
FIG, 1

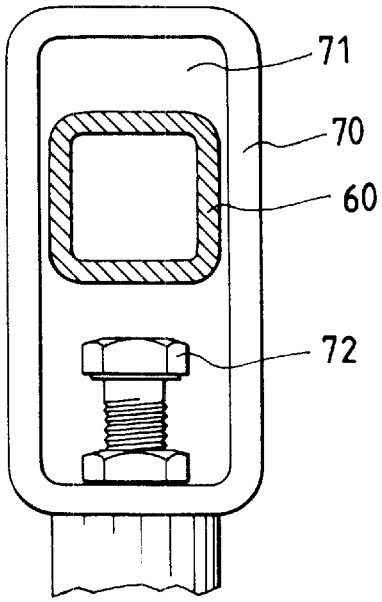
FIG, 2
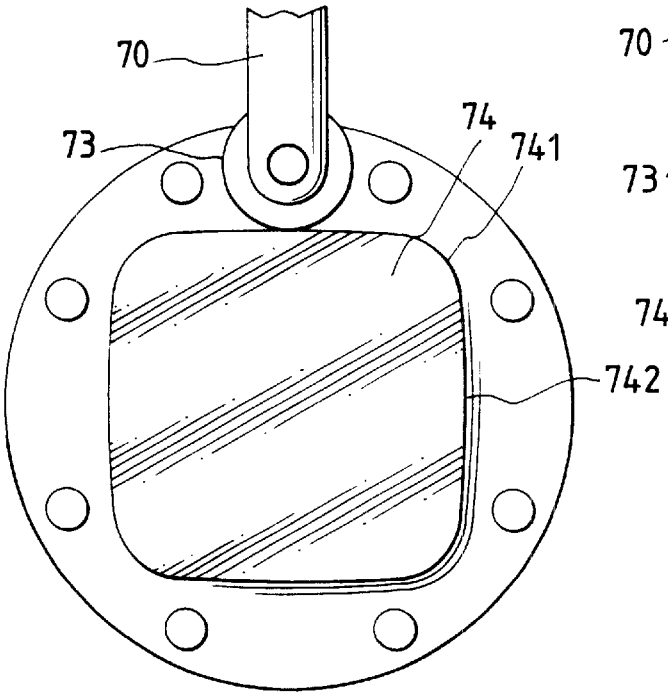
FIG, 3
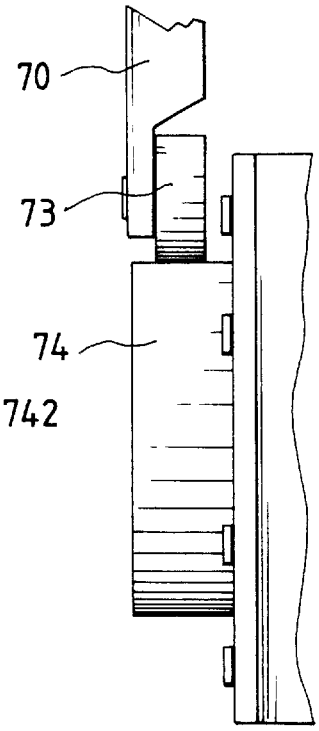
FIG, 5

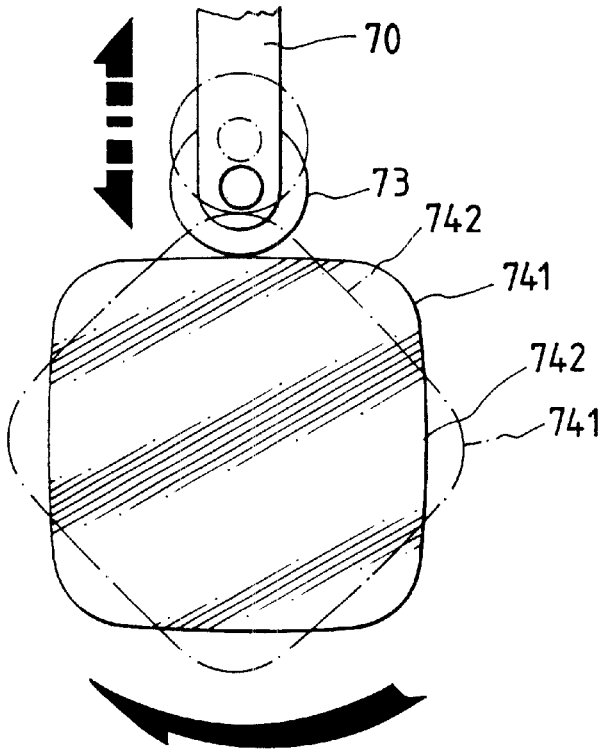
FIG, 4
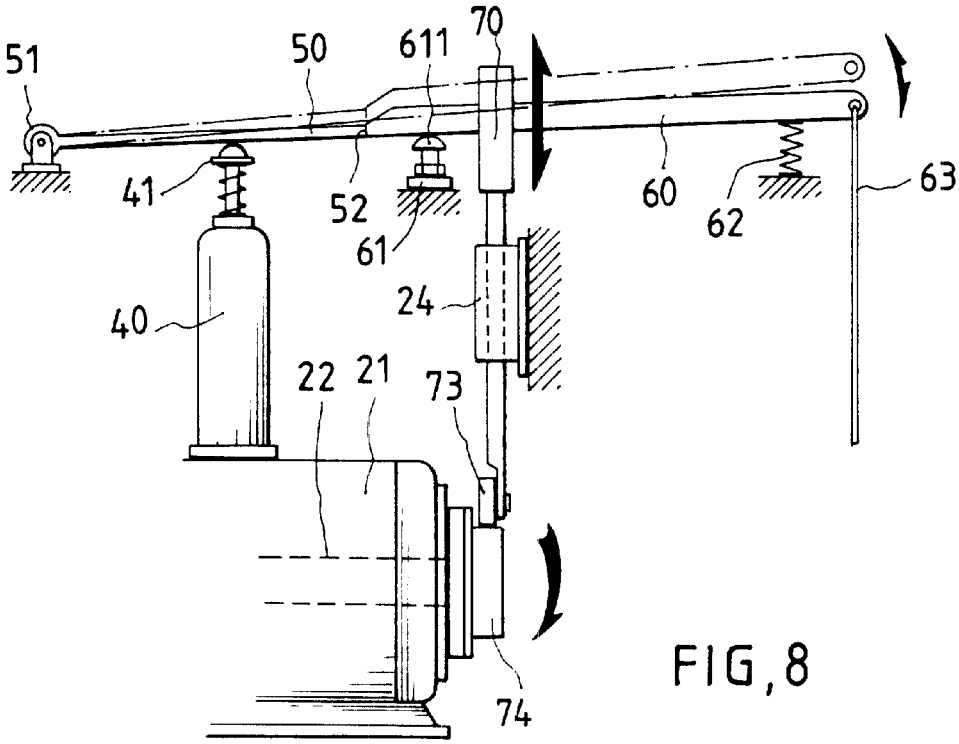
FIG, 8

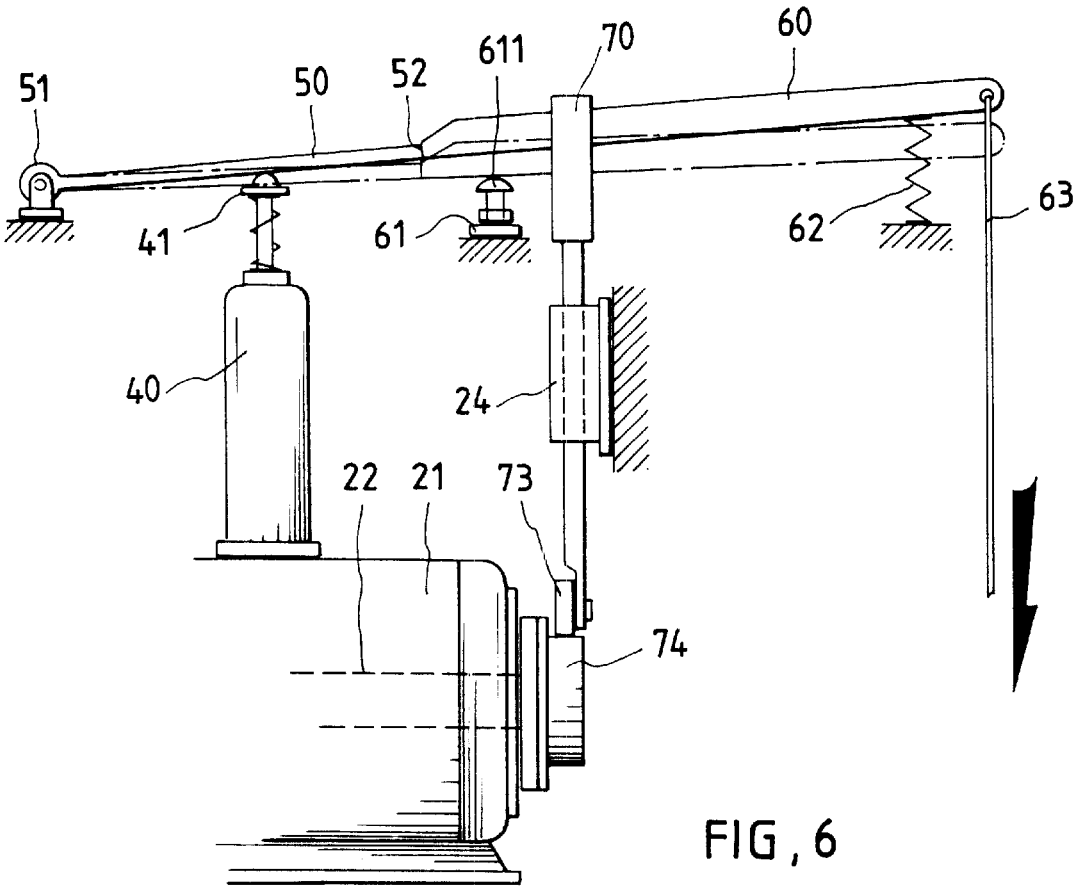
FIG, 6
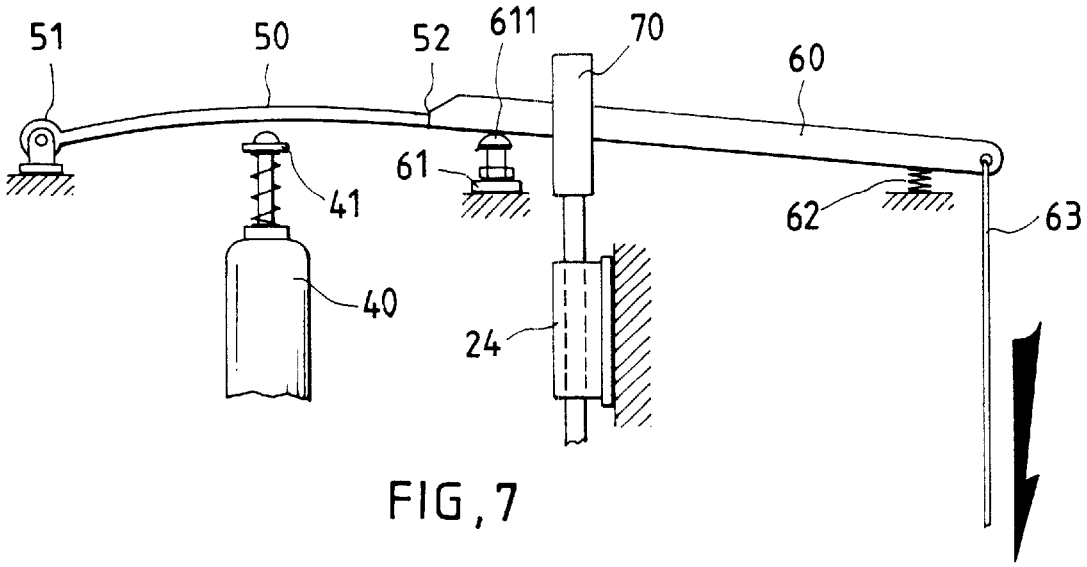
FIG, 7

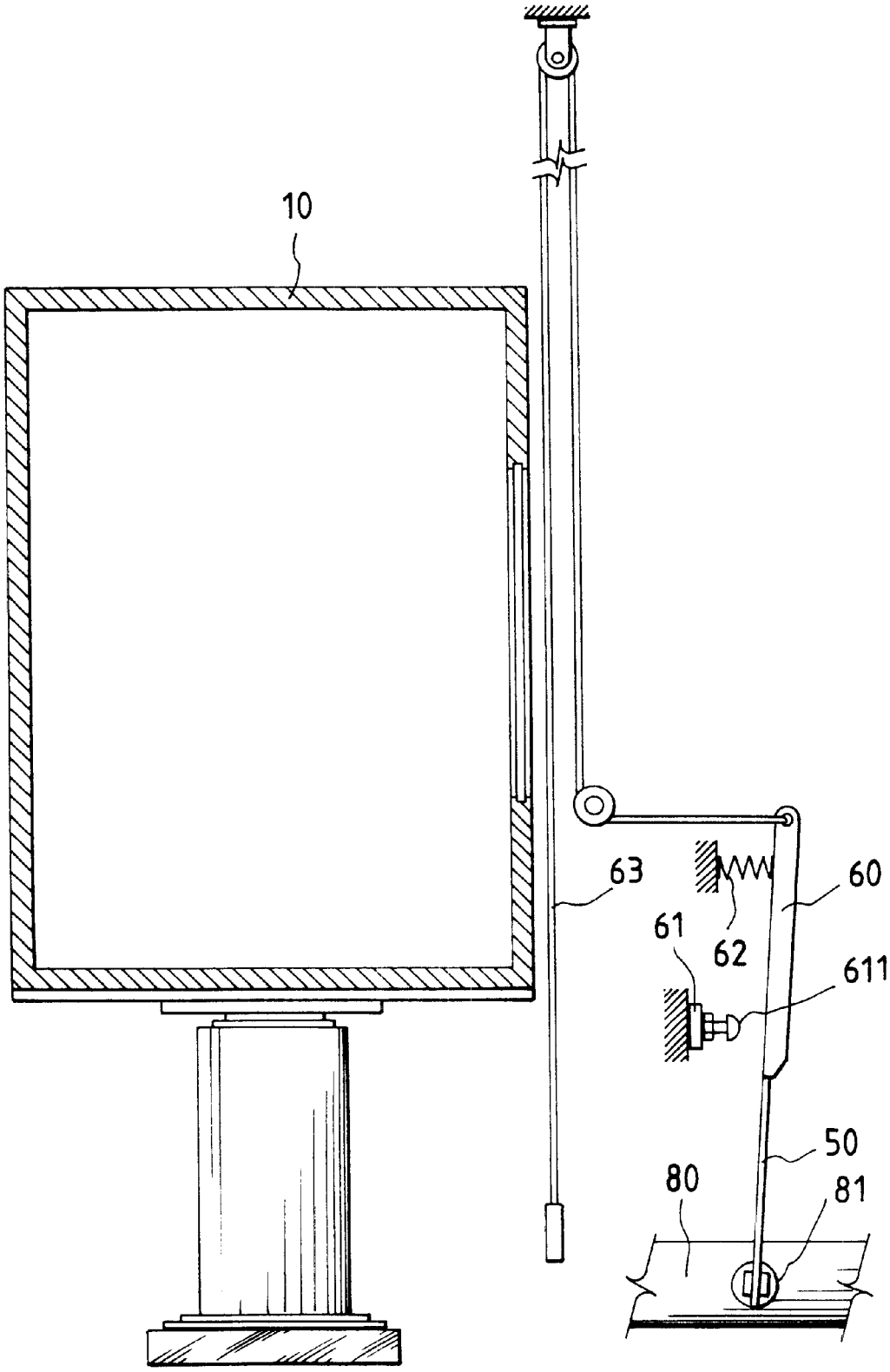
FIG, 9

PROTECTIVE MEANS AGAINST INERTIAL SLIP OF ELEVATOR CAB DURING BRAKE RELEASE IN AN EMERGENCY

FILED OF THE INVENTION

The present invention relates to a protective means against inertial slip of elevator cab during brake release in an emergency, and more particularly to a protective means cooperated with an escape and protection mechanism of general elevators. When the escape and protection mechanism is actuated by pulling an escape pulling cable to release a braked cab, the protective means works to enable the cab to repeatedly released and braked and thereby move upward or downward at a reduced safety speed to ensure the safety of passengers in the cab. In the event the escape pulling cable is overly pulled, the protective means prevents the escape and protection mechanism from being actuated and the braked cab is not released.

BACKGROUND OF THE INVENTION

An elevator for high-rise buildings is usually driven to ascend or descend by a driving motor that includes a driving wheel connected to a rotary shaft of the motor. Hoist cables are wound around the driving wheel and driven to lift or lower an elevator cab. There is also an escape and protection mechanism designed for each elevator, such that an elevator cab braked in an emergency could be released manually by pulling an escape pulling cable or mechanically by actuating a stand-by battery. The released elevator cab could therefore move again.

A potential problem existing in the conventional escape and protection mechanism for an elevator cab that employs the principle of counterweight balance is that the brake-released cab tends to ascend or descend at an accelerated speed due to a gravity force and therefore very possibly endangers passengers in the cab.

Another problem with the conventional escape and protection mechanism for an elevator cab is that a panic passenger might very possibly pull the escape pulling cable so hard that some components included in the escape and protection mechanism are damaged or become disordered.

It is therefore tried by the inventor to develop a protective means against inertial slip of elevator cab during brake release in an emergency to overcome the problems existing in the conventional escape and protection mechanism for an elevator.

SUMMARY OF THE INVENTION

A primary object of the present invention is to provide a protective means against inertial slip of elevator cab during brake release in an emergency that works to enable a brake-released elevator cab to repeatedly released and braked and thereby move upward or downward at a reduced safety speed to ensure the safety of passengers in the cab.

Another object of the present invention is to provide a protective means against inertial slip of elevator cab during brake release in an emergency that would not work to release a braked elevator cab when the escape pulling cable for actuating the escape and protection mechanism of the elevator is overly pulled.

To achieve the above and other objects, the protective means against inertial slip of elevator cab during brake release in an emergency according to the present invention mainly includes an actuating arm connected at a rear end to the escape pulling cable of an elevator cab, and at a front end to a rear end of a flexible long member. The flexible long member is pivotally connected at a front end to a mechanical control chamber above the elevator cab. The protective means also includes a manual brake release control means having a linking member connected at an upper end to the actuating arm and at a lower end to a cam mounted on the rotary shaft of the driving motor of the elevator. By pulling the escape pulling cable outside the cab with a normal force to decline the actuating arm, the flexible long member is brought downward to press against a manual brake-release shaft connected to the driving motor of the elevator and thereby releases the braked cab. When the cab is released and the driving motor rotates again, the cam mounted on the rotary shaft of the motor rotates at the same time to reciprocate the linking member up and down, causing the flexible member to repeatedly release and press the manual brake-release shaft and thereby intermittently brake and release the cab for the same to move upward or downward at a reduced safety speed.

In the event a panic passenger overly pulls the escape pulling cable, the actuating arm would touch a support near the front end of the actuating arm before the flexible long member is naturally swung downward, resulting in an upward arched flexible long member that does not contact with the manual brake-release shaft to release the braked cab. When the overly pulled escape pulling cable is released and then pulled again with a normal force, the manual brake-release shaft could be depressed by the flexible long member to release the braked cab. In this manner, the whole escape and protection mechanism of the elevator and the protective means of the present invention could function safely.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein FIG. 1 is an elevational plan view showing a preferred embodiment of the present invention for use with a cable-controlled elevator system;

FIG. 2 is a fragmentary enlarged plan view of FIG. 1 viewed in a direction indicated by arrow 2;

FIG. 3 is a fragmentary enlarged plan view of FIG. 1 viewed in a direction indicated by arrow 3;

FIG. 4 is a fragmentary plan view of FIG. 3 showing the movement of a squarish cam included in the present invention;

FIG. 5 is a side view of FIG. 3;

FIG. 6 illustrates the operation of the preferred embodiment of the present invention of FIG. 1 to release an elevator cab braked in an emergency;

FIG. 7 illustrates a flexible long member included in the present invention is upward arched when an escape pulling cable of the elevator is overly pulled;

FIG. 8 shows the preferred embodiment of the present invention of FIG. 1 repeatedly releases and brakes the elevator cab for the same to move at a reduced safety speed; and FIG. 9 is an elevational plan view of another embodiment of the present invention for use with an oil-pressure elevator system.

DETAILED DESCRIPTION OF THE PREFERRED EMBODIMENTS

Please refer to FIG. 1 that is an elevational plan view showing a preferred embodiment of the present invention for use with a cable-controlled elevator system.

As can be seen from FIG. 1, the cable-controlled elevator system mainly includes a cab 10, a set of hoist cables 11, an elevator mechanical control chamber 20 above the cab 10 and having a driving motor 21 mounted therein to drive the hoist cables 11 via a motor shaft 22 and a driving wheel 23 connected to the motor shaft 22, a variable gear set 30 mounted on the motor shaft 22, and a braking device 40 connected to the variable gear set 30. In addition to an internal automatic brake release means, the braking device 40 includes an external manual brake-release shaft 41 projected from a top of the braking device 40. In the mechanical control chamber 20, there is also provided an escape pulling cable 63 extended to one outer side of the cab 10 for releasing the braking device 40. The escape pulling cable 63 and the manual brake-release shaft 41 and the braking device 40 together form an escape and protection mechanism of the elevator.

The protective means against inertial slip of elevator cab during brake release in an emergency according to the present invention includes a flexible long member 50 having a front end 51 pivotally connected to a predetermined point in the control chamber 20, a middle portion in contact with a top of the manual brake-release shaft 41, and a rear end 52; an actuating arm 60 having a head to which the rear end 52 of the flexible long member 50 is fixedly connected, a point slightly behind the head supported on a height-adjustable screw 611 fixed on a top of a support 61, a tail connected to an end of the escape pulling cable 63 which is downward extended along one outer side of the cab 10 and is provided at a predetermined point with an electromagnetic actuator 64 connected to a battery 65, and a point in front of the tail and in contact with an elastic element 62 that normally pushes the tail of the actuating arm 60 upward; and a manual brake release control means connected to a point of the actuating arm 60 slightly behind the support 61.

Please refer to FIGS. 1 to 5 at the same time. The manual brake release control means includes a linking member 70 having an upper frame portion defining a hole 71 through which the actuating arm 60 extends to move only within the hole 71, and a lower stem portion downward extended from the frame portion to connect at a lower end to a rotatable bearing 73. An adjusting screw bolt 72 is located in and screwed to a lower end of the frame portion to adjust a vertical range within which the actuating arm 60 may be moved up or down. A middle section of the stem portion is confined in a sleeve 24 fixedly mounted in the mechanical control chamber 20 at a predetermined position, so that the linking member 70 is limited by the sleeve 24 to move vertically only. The manual brake release control means also includes a squarish cam 74 that is fixedly mounted on the rotary shaft 22 of the driving motor 21 to contact with the bearing 73 connected to the lower end of the linking member 70.

Please refer to FIG. 6. When the cab 10 is braked in an emergency and the escape pulling cable 63 is pulled, the actuating arm 60 and accordingly the flexible long member 50 fixedly connected to the actuating arm 60 are caused to swing down about the front end 51 of the flexible long member 50. At this point, the flexible long member 50 is brought to depress the manual brake-release shaft 41 to release the braking device 40, allowing the cab 10 to ascend or descend again, depending on a relation of the cab 10 to a counterweight (not shown) of the elevator at the time the elevator was emergently braked. The cab 10 would usually move in a direction decided by the heavier one of the counterweight and the cab 10.

Please refer to FIG. 7. In the event the escape pulling cable 63 is instantaneously overly pulled, such that the actuating arm 60 touches the screw 611 at the support 61 before the flexible long member 50 is naturally swung downward, resulting in a condition shown in FIG. 7. That is, a middle portion of the flexible long member 50 becomes upward arched without contacting with he manual brake-release shaft 41 and the braking device 40 is not released. from a braked condition. This protects the braking device 40 against disorder or damage possibly caused by improper operation of the escape pulling cable 63. When the overly pulled escape pulling cable 63 is released and then pulled again with a normal force, the braking device 40 could be released through the actuating arm 60 and the flexible long member 50.

As mentioned above, when the braking device 40 is manually released in the manner as shown in FIG. 6, the cab 10 will ascend or descend again, depending on a relation of a load of the cab 10 to the counterweight of the elevator at the time the elevator was emergently braked. It is rarely the counterweight and the cab 10 are just in a balanced condition, and the cab 10 would usually move in a direction decided by the heavier one of the counterweight and the cab 10. When the counterweight or the cab 10 moves downward after the braking device 40 is released, either of them accelerates like a free faller and causes the hoist cables 11, the rotary shaft 22 and the driving motor 21 to move again. At this point, the driving motor 21 brings the cam 74 on the rotary shaft 22 to rotate at the same time. As can be clearly seen in FIGS. 4 and 8, when the cam 74 rotates, it intermittently pushes the bearing 73 upward to cause the linking member 70 connected at a lower end to the bearing 73 to reciprocate up and down. When the cam 74 rotates with a high point 741 thereof becoming in contact with the bearing 73, as shown in FIG. 4, the linking member 70 is moved upward and forces the previously downward pulled actuating arm 60 to also move upward, such that the flexible long member 50 is disengaged from the manual brake-release shaft 41, allowing the braking device 40 to brake again. When the cam 74 rotates with a low point 742 becoming in contact with the bearing 73, the linking member 70 is lowered and forces the actuating arm 60 downward for the flexible long member 50 to swing down and press against the manual brake-release shaft 41, releasing the braking device 40 and allowing cab 10 to move again. With the manual brake release control means, the cab 10 is repeatedly braked and released and can therefore keep moving up or down at a reduced safety speed to ensure the safety of passengers in the cab 10.

FIG. 9 illustrates another embodiment of the present invention for use with an oil-pressure controlled elevator system. As shown, the oil-pressure controlled elevator mainly includes a cab 10, and a pressure-relief pipe 80 having a pressure-relief valve 81. When the pressure-relief valve 81 is turned by a predetermined angle, oil in a main oil-pressure cylinder (not shown) for lifting the cab 10 is caused to flow back to an oil reservoir (not shown). The protective means against inertial slip of elevator cab during brake release in an emergency according to this embodiment of the present invention includes a flexible long member 50 having a front end fixedly connected to the pressure-relief valve 81, an actuating arm 60 having a head fixedly connected to a rear end of the flexible long member 50, and an escape pulling cable 63 provided at an outer side of the cab 10 with an end connected to a tail of the actuating arm 60. When a passenger in the emergently braked cab 10 pulls the escape pulling cable 63, the actuating arm 60 and accordingly the flexible long member 50 are pulled to turn the pressure-relief valve 81 by an angle and thereby relieve a pressure in the oil pressure cylinder for the cab 10 to descend slowly. In the event the escape pulling cable 63 is overly pulled, such that the actuating arm 60 is in contact with a screw 611 on a support 61 before the flexible long member 50 is naturally swung about its front end, and the flexible long member 50 will become arched with its front end to swing in a reverse direction by an angle, causing the pressure-relief valve 81 to turn back and stop releasing oil from the oil pressure cylinder to the oil reservoir. In this manner, the cab 10 is prevented from abrupt and dangerous descending to endanger passengers in the cab 10.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A protective means against inertial slip of an elevator cab during brake release in an emergency, said elevator cab being driven by a driving motor mounted in a mechanical control chamber above said cab and being braked through a braking device connected to said driving motor via a variable gear set connected to a rotary shaft of said driving motor, said protective means comprising:

a flexible long member having a front end pivotally connected to a predetermined point in said control chamber, a middle portion in contact with a top of a manual brake-release shaft of said braking device, and a rear end;

an actuating arm having a head to which said rear end of said flexible long member is fixedly connected, a point slightly behind said head being supported on a support, and a tail being connected to an end of an escape pulling cable that is downward extended along one outer side of said cab; and a manual brake release control means connected to a point of said actuating arm slightly behind said support; and said manual brake release control means including a linking member having an upper frame portion defining a hole through which said actuating arm extends to move only within said hole, and a lower stem portion downward extended from said frame portion, a middle section of said stem portion being confined in a sleeve fixedly mounted in said mechanical control chamber at a predetermined position, so that said linking member is limited by said sleeve to move vertically only; an adjusting screw bolt being located in and screwed to a lower end of said frame portion to adjust a vertical range within which said actuating arm may be moved up or down; a bearing being fixedly connected to a lower end of said stem portion of said linking member; and a cam being fixedly mounted on said rotary shaft of said driving motor to be always in contact with said bearing;

whereby when said cab is braked in an emergency and said escape pulling cable is pulled with a normal force, said actuating arm and said flexible long member are caused to depress said manual brake-release shaft to release said braking device, allowing said cab to ascend or descend again, depending on a relation of said cab to a counterweight of said elevator at the time said elevator was emergently braked, and to rotate said rotary shaft of said driving motor as well as said cam connected to said rotary shaft, such that said cam intermittently pushes said bearing and accordingly reciprocates said linking member up and down, causing said actuating arm and said flexible long member to repeatedly release and depress said manual brake-release shaft and thereby repeatedly brake and release said cab for the same to keep moving up or down at a reduced safety speed; and when said escape pulling cable is overly pulled, said actuating arm touches said screw at said support first to result in an upward arched flexible long member that disengages from said manual brake-release shaft and does not release said braking device, leaving said cab in a braked state.

2. The protective means against inertial slip of an elevator cab during brake release in an emergency as claimed in claim 1, wherein said support of said actuating arm is provided at a top with a height-adjustable screw.

3. The protective means against inertial slip of an elevator cab during brake release in an emergency as claimed in claim 1, wherein said cam is a squarish cam adapted to cyclically provide a high point and a low point along a peripheral edge thereof.

* * * * *